US006615444B2

(12) United States Patent
McGilll et al.

(10) Patent No.: US 6,615,444 B2
(45) Date of Patent: Sep. 9, 2003

(54) DIRT COLLECTION SYSTEM FOR A VACUUM CLEANER

(75) Inventors: James A. McGilll, Canton, OH (US); David M. J. Allgeier, Canton, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/852,073

(22) Filed: May 9, 2001

(65) Prior Publication Data

US 2002/0166198 A1 Nov. 14, 2002

(51) Int. Cl.[7] ..... A47L 9/14

(52) U.S. Cl. ..... 15/352; 15/353; 55/DIG. 3; 55/433

(58) Field of Search ..... 15/350, 352, 353; 220/262, 263, 264, 676, 254, 601; 55/DIG. 3, 429, 432, 433

(56) References Cited

U.S. PATENT DOCUMENTS

| | | | | | |
|---|---|---|---|---|---|
| 2,863,525 | A | | 12/1958 | Lucian | 183/37 |
| 3,130,856 | A | * | 4/1964 | Gits | 220/263 |
| 3,550,181 | A | | 12/1970 | Dolan et al. | 15/320 |
| 4,405,346 | A | | 9/1983 | Tschudy et al. | 15/357 |
| 4,927,047 | A | * | 5/1990 | Stuber et al. | 220/263 |
| 5,107,567 | A | | 4/1992 | Ferrari et al. | 15/350 |
| 5,659,922 | A | | 8/1997 | Louis | 15/350 |
| 5,664,285 | A | | 9/1997 | Melito et al. | 15/352 |
| 5,713,103 | A | | 2/1998 | Keebler et al. | 15/323 |
| 5,739,758 | A | * | 4/1998 | Driska et al. | 220/263 |
| D436,425 | S | | 1/2001 | Salo et al. | D32/25 |
| 6,192,550 | B1 | | 2/2001 | Hamada et al. | 15/352 |
| 6,256,834 | B1 | * | 7/2001 | Meijer et al. | 15/352 |
| 6,269,518 | B1 | * | 8/2001 | Yung | 15/352 |
| 6,341,404 | B1 | * | 1/2002 | Salo et al. | 15/350 |
| 6,353,963 | B1 | * | 3/2002 | Bair et al. | 15/352 |
| 6,375,696 | B2 | * | 4/2002 | Wegelin et al. | 15/352 |
| 6,385,810 | B1 | * | 5/2002 | Lang | 15/352 |
| 6,393,656 | B1 | * | 5/2002 | Paterson et al. | 15/352 |
| 6,406,505 | B1 | * | 6/2002 | Oh et al. | 15/353 |

* cited by examiner

*Primary Examiner*—Theresa T. Snider
(74) *Attorney, Agent, or Firm*—A. Burgess Lowe; Michael J. Corrigan

(57) ABSTRACT

A dirt collecting system for a vacuum cleaner includes a dirt cup having a dirt collecting chamber. The dirt cup is removably inserted into the housing of a vacuum cleaner. When the dirt cup is inserted into the housing, the dirt cup is fluidly connected to the suction nozzle and a suction source. The dirt cup is provided with a pivotally connected lid and a thumb tab located on the lid. The thumb tab is used to move the lid into the open position when the dirt cup is emptied. A handle is provided on the front of the dirt cup for grasping the dirt cup during removal from the vacuum cleaner housing and during emptying.

11 Claims, 6 Drawing Sheets

DIRT COLLECTION SYSTEM FOR A VACUUM CLEANER

FIELD OF THE INVENTION

Generally, the invention relates to vacuum cleaners. Particularly, the invention relates to a dirt collection system for a vacuum cleaner.

BACKGROUND OF THE INVENTION

Upright vacuum cleaners are well known in the art. Typically, these upright vacuum cleaners include a vacuum cleaner housing pivotally mounted to a vacuum cleaner foot. The foot is formed with a nozzle opening and may include an agitator mounted therein for loosening dirt and debris from a floor surface. A motor may be mounted to either the foot or the housing for producing suction at the nozzle opening. The suction at the nozzle opening picks up the loosened dirt and debris and produces a stream of dirt-laden air which is ducted to the vacuum cleaner housing.

In conventional vacuum cleaners, the dirt laden air is ducted into a vacuum cleaner filter bag supported on or within the vacuum cleaner housing. However, bagless vacuum cleaners have recently become prevalent in the marketplace. These bagless vacuum cleaners duct the stream of dirt-laden air into a dirt cup having a dirt collecting system which filters the dirt particles from the air stream before exhausting the filtered air stream into the atmosphere. Various dirt collecting systems have been used on these bagless vacuum cleaners to separate the dirt particles from the air stream. The bagless cleaners generally use a receptacle such as a dirt cup for collecting dirt and debris for later disposal.

One such dirt cup for a vacuum cleaner was disclosed in U.S. patent application Ser. No. 09/519,106 owned by a common assignee which is incorporated by reference fully herein. However, the need still exists to routinely empty the dirt cup. The present invention provides an improvement to aid the emptying of debris from a dirt for a dirt collecting system such as the one disclosed in U.S. patent application Ser. No. 09/519,106 owned by a common assignee.

Objectives of the invention include providing a new and improved dirt collecting system for use in a bagless vacuum cleaner.

A further objective is to provide a new and improved dirt collecting system which provides dirt cup having a pivoting lid.

A still further objective is to provide a dirt cup with a handle for grasping the dirt cup for the purpose of handling the dirt cup.

A still yet further objective is to provide a dirt cup having a lid with a thumb tab for opening the lid.

These and other objectives will be readily apparent from the following description taken in conjunction with the accompanying drawings.

SUMMARY OF THE INVENTION

In carrying out the invention in one aspect thereof, these objectives and advantages are obtained by providing a dirt collecting system for a vacuum cleaner, the vacuum cleaner comprised of a nozzle opening which may include an agitator mounted therein for loosening dirt and debris from a floor surface. A motor-fan assembly may be mounted to either the foot or the housing for producing suction at the nozzle opening. The suction at the nozzle opening picks up the loosened dirt and debris and produces a stream of dirt-laden air which is ducted to the vacuum cleaner housing.

In the preferred embodiment of the invention, the dirt collecting system includes a dirt cup removably inserted into the vacuum cleaner housing. The dirt cup is comprised of a dirt collecting chamber, a lid pivotally connected to the dirt cup and having a thumb tab for opening the lid, and a handle on the front of the dirt cup for handling the dirt cup. The dirt cup is emptied by removing the dirt cup from the vacuum cleaner housing. The handle on the front of the dirt cup is provided for this purpose. While still grasping the handle, the dirt cup is emptied of debris by pressing on the thumb tab and inverting the dirt cup over a debris collection receptacle. The debris in the dirt cup will fall from the dirt cup into the debris collection receptacle. After emptying the dirt cup is returned upright, the thumb tab is released and the dirt cup is re-inserted into the vacuum cleaner housing.

BRIEF DESCRIPTION OF DRAWINGS

Embodiments of the invention, illustrative of several modes in which applicants have contemplated applying the principles are set forth by way of example in the following description and are shown in the drawings and are particularly and distinctly pointed out and set forth in the appended claims.

DESCRIPTION OF THE PREFERRED EMBODIMENT

Figure 1:
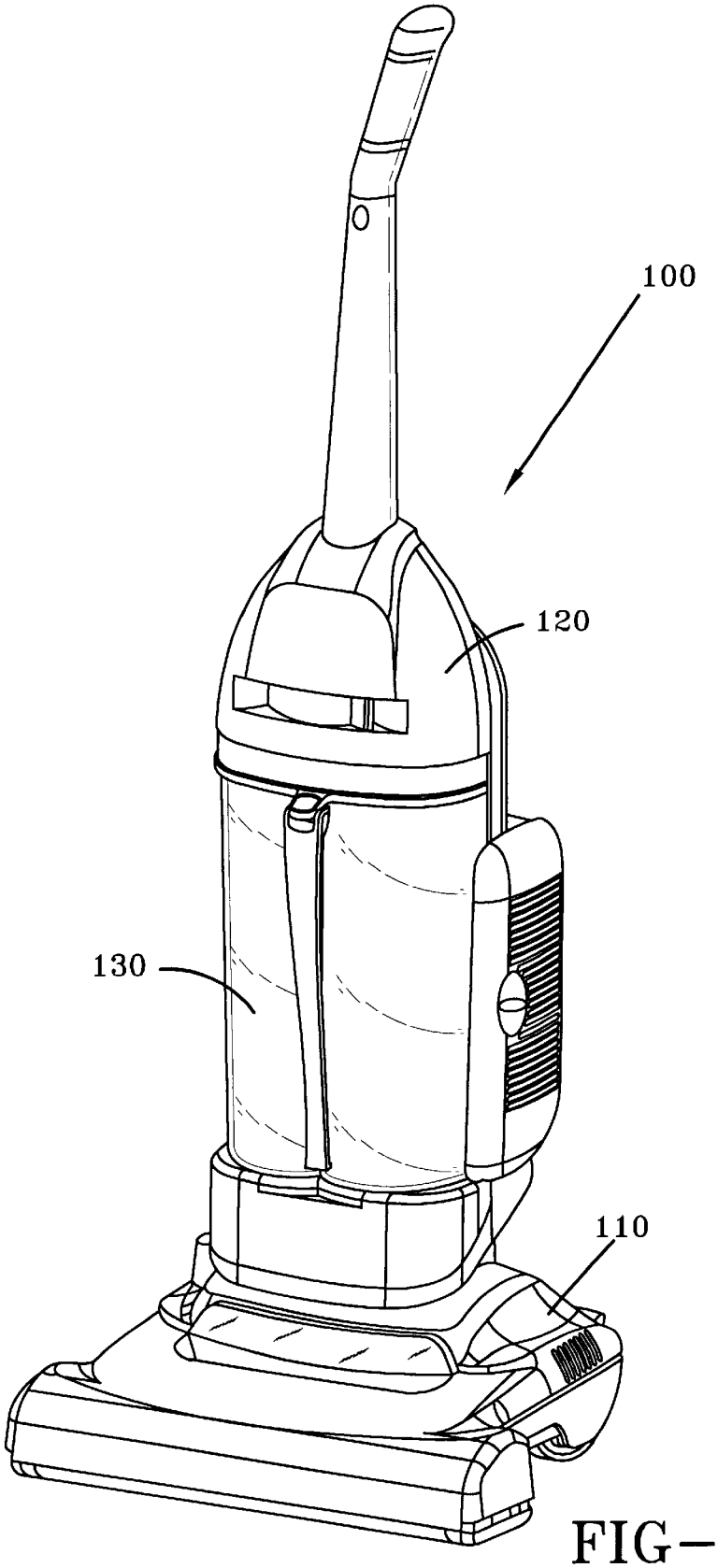
FIG. 1 is a left perspective view of a vacuum cleaner which includes the present dirt collecting system.
Figure 2:
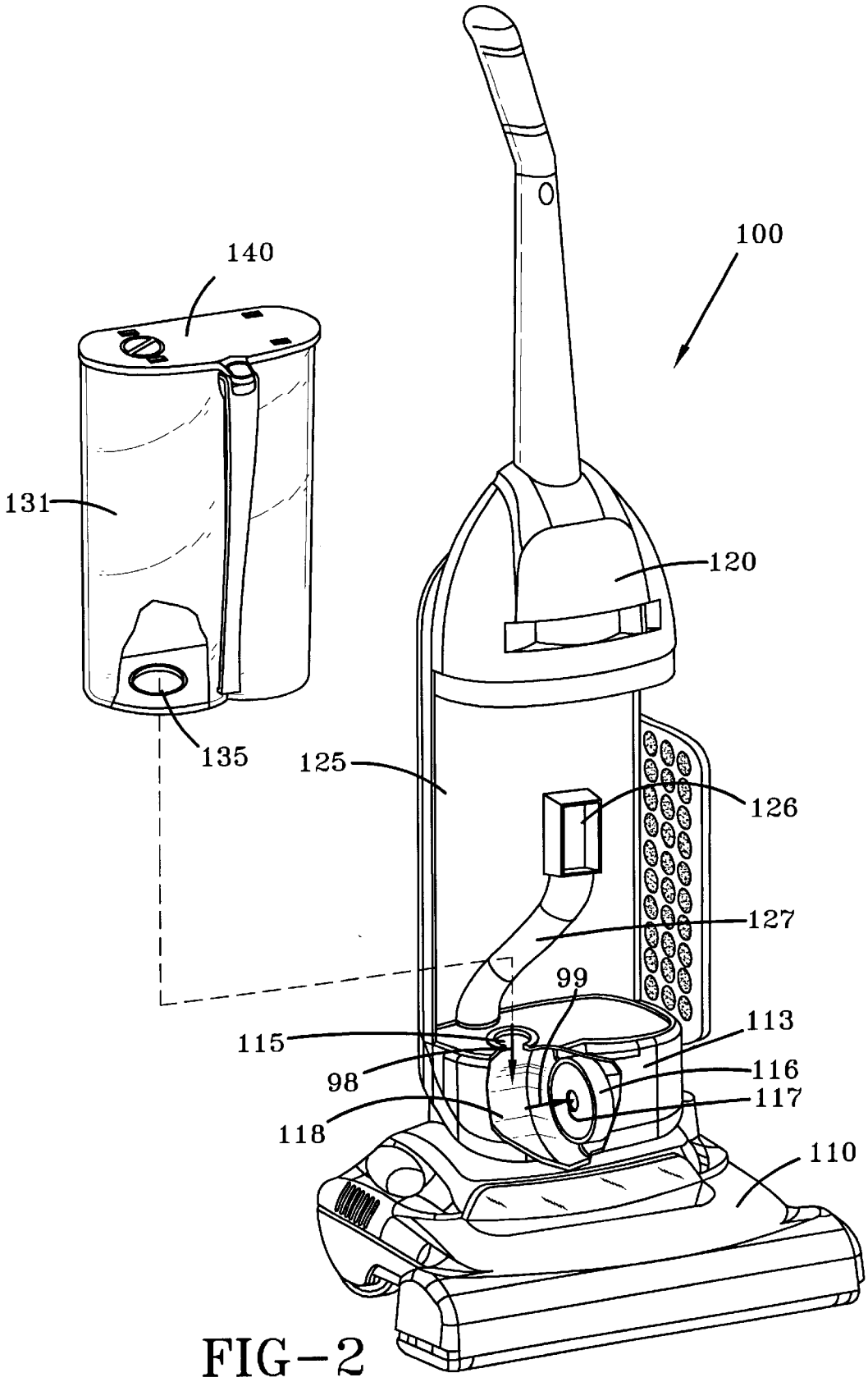
FIG. 2 is a right perspective view of the vacuum cleaner of FIG. 1 with a cutaway of a portion of the dirt cup and motor housing.
Figure 3:
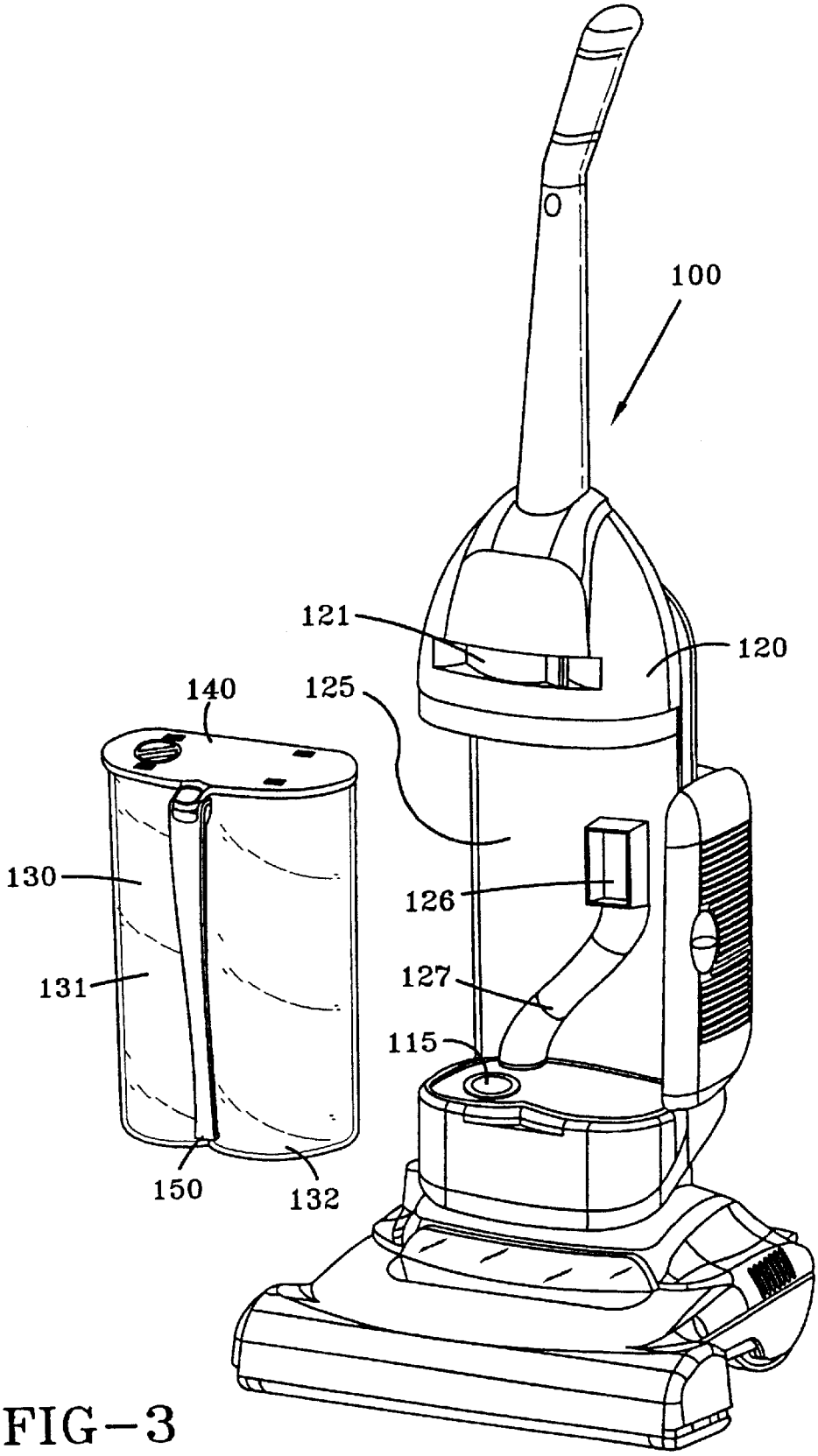
FIG. 3 is a left perspective view of the vacuum cleaner of FIG. 1 with the dirt collecting assembly removed from the cleaner housing.
Figure 4:
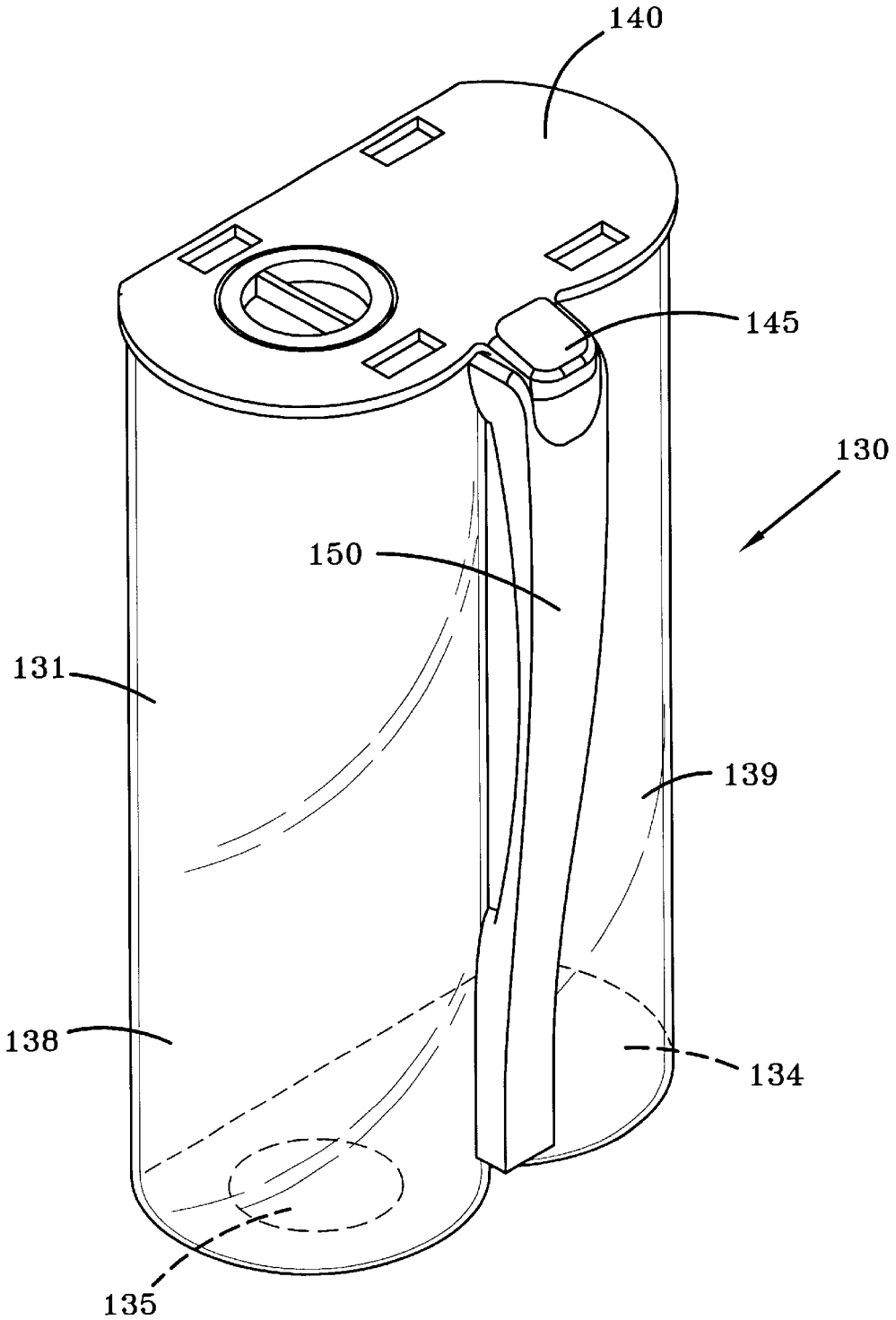
FIG. 4 is a left perspective of the dirt collecting assembly of FIG. 3 with the lid in the closed position.

A vacuum cleaner incorporating the present dirt collecting system is shown in FIG. 1 and is indicated generally at 100. Vacuum cleaner 100 includes a vacuum cleaner foot 110 and a vacuum cleaner housing 120 connected to the vacuum cleaner foot 110. The foot 110 is formed with a bottom nozzle opening (not shown) which opens towards a floor surface. The vacuum cleaner 100 is of the type having an agitator (not shown) positioned within an agitator chamber (not shown) in foot 110 which communicates with the nozzle opening. The agitator rotates about a horizontal axis for loosening dirt from the floor surface. The present dirt collecting system 130 is removably inserted into the housing 120 of vacuum cleaner 100. The design of the cleaner is generally similar to the cleaner disclosed in U.S. patent application Ser. No. 09/519,106 owned by a common assignee and described previously.

Referring now to FIGS. 2 through 5, a motor-fan assembly 116 is fluidly connected to the dirt collecting system 130 via an motor housing cavity inlet opening 115 located on top (of motor housing 113 located beneath the lower portion of housing 120 and a clean air outlet opening 135 in the bottom of dirt cup 131. A hermetic seal between clean air outlet opening 135 and motor housing cavity inlet opening 115 is created when dirt cup 131 is inserted into cavity 125 of housing 120. Dirt cup 131 may be held releasably within cavity 125 by a latch 121 (FIG. 3) or other means. Dirt cup 131 is fluidly connected to the agitator chamber (not shown) by a dirt duct 127. Dirt duct 127 is fluidly connected to dirt cup 131 by a dirt duct connector 126 and a dirty air inlet opening 136 (FIG. 6) in the rearwall 137 (FIG. 6) of dirt cup 131. Motor-fan assembly 116 has a suction inlet opening 117 which creates a suction in a motor housing cavity 118 located adjacent to motorfan assembly 116. The suction created by motor-fan assembly 116 creates an airstream which draws in dirt-laden air from the agitator chamber (not shown) into dirt cup 131 through dirt duct 127 and dirty air inlet opening 137. The dirt laden airstream is then filtered in dirt cup 131 and the filtered airstream exits dirt cup 131 through clean air outlet opening 135. The airstream enters motor housing cavity 118 through motor housing cavity inlet opening 115. The airstream is moving in a generally vertical direction (represented by arrow 98) as it enters motor housing cavity 118 but must turn in a generally horizontal direction (represented by arrow 99) as it enters the suction inlet opening 117 of motor-fan assembly 116. Motor-fan assembly 116 has a generally horizontal orientation within motor housing 113. One or more particle filters may be provided inside dirt cup 131 between dirty air inlet 136 and clean air outlet 135 to prevent dirt particles and debris from exiting dirt cup 131 through clean air outlet 135.

Please replace the second paragraph on page 4 with the following paragraph: Dirt cup 131 includes a bottom wall 134, a generally flat rear wall 137, a pair of curved side walls 138 and 139, and a handle 150. Rear wall 137 (FIG. 5) and side walls 138, 139 extend upwardly from a bottom wall 134 to form a single dirt collecting chamber 132. The curved sidewalls 138, 139 curve inwardly and meet at the front center indentation. A handle 150 is provided on the front of the dirt cup 131 to allow easy handling of the dirt cup 131. A lid 140 is also provided for sealing dirt cup 131 and dirt collecting system 130 when in the installed position in cleaner 100. Lid 140 is pivotally connected to dirt cup 131 and is shown in the closed or sealing position in FIG. 3. One or more particle separating filters (not shown) may be provided in dirt collecting chamber 132 between dirty air inlet 136 and clean air outlet 135 to prevent dirt particles and debris from exiting dirt cup 131 through clean air outlet 135.

Dirt cup 131 includes a bottom wall 134, a generally flat rear wall 137, a pair of curved side walls 138 and 139, and a handle 150. Rear wall 137 (FIG. 5) and side walls 138, 139 extend upwardly from a bottom wall 134 to form a single dirt collecting chamber 132. The curved sidewalls 138, 139 curve inwardly and meet at a front center indentation. A handle 150 is provided on the front of the dirt cup 131 to allow easy handling of the dirt cup 131. A lid 140 is also provided for sealing dirt cup 131 and dirt collecting system 130 when in the installed position in cleaner 100. Lid 140 is pivotally connected to dirt cup 131 and is shown in the closed or sealing position in FIG. 3. One or more particle separating filters (not shown) may be provided in dirt collecting chamber 132 between dirty air inlet 136 and clean air outlet 135 to prevent dirt particles and debris from exiting dirt cup 131 through clean air outlet 135.

In the preferred embodiment of the invention, lid 140 is pivotally attached to dirt cup 131 at the top of handle 150. The connection of lid 140 to dirt cup 131 via handle 150 is described more fully hereinbelow. A thumb tab 145 extends from the front side and center of the peripheral edge of lid 140. Thumb tab 145 is also centered over handle 150 so that when handle 150 is grasped, thumb tab 145 may be easily depressed by the thumb. When thumb tab 145 is depressed in the direction of arrow 205, as when it is desired to empty accumulated debris from dirt cup 131, lid 140 is pivoted in the direction of arrow 200 (FIG. 4) to the open position and remains in the open position (FIG. 4) until thumb tab 145 is released. Handle 150 is also used to invert dirt cup 131 for the purpose of emptying accumulated debris from dirt collecting chamber 131. Thus, lid 140 of dirt cup 131 may be opened by depressing thumb tab 145 with a thumb from the same hand as the hand used to invert dirt cup 131.

Figure 5:
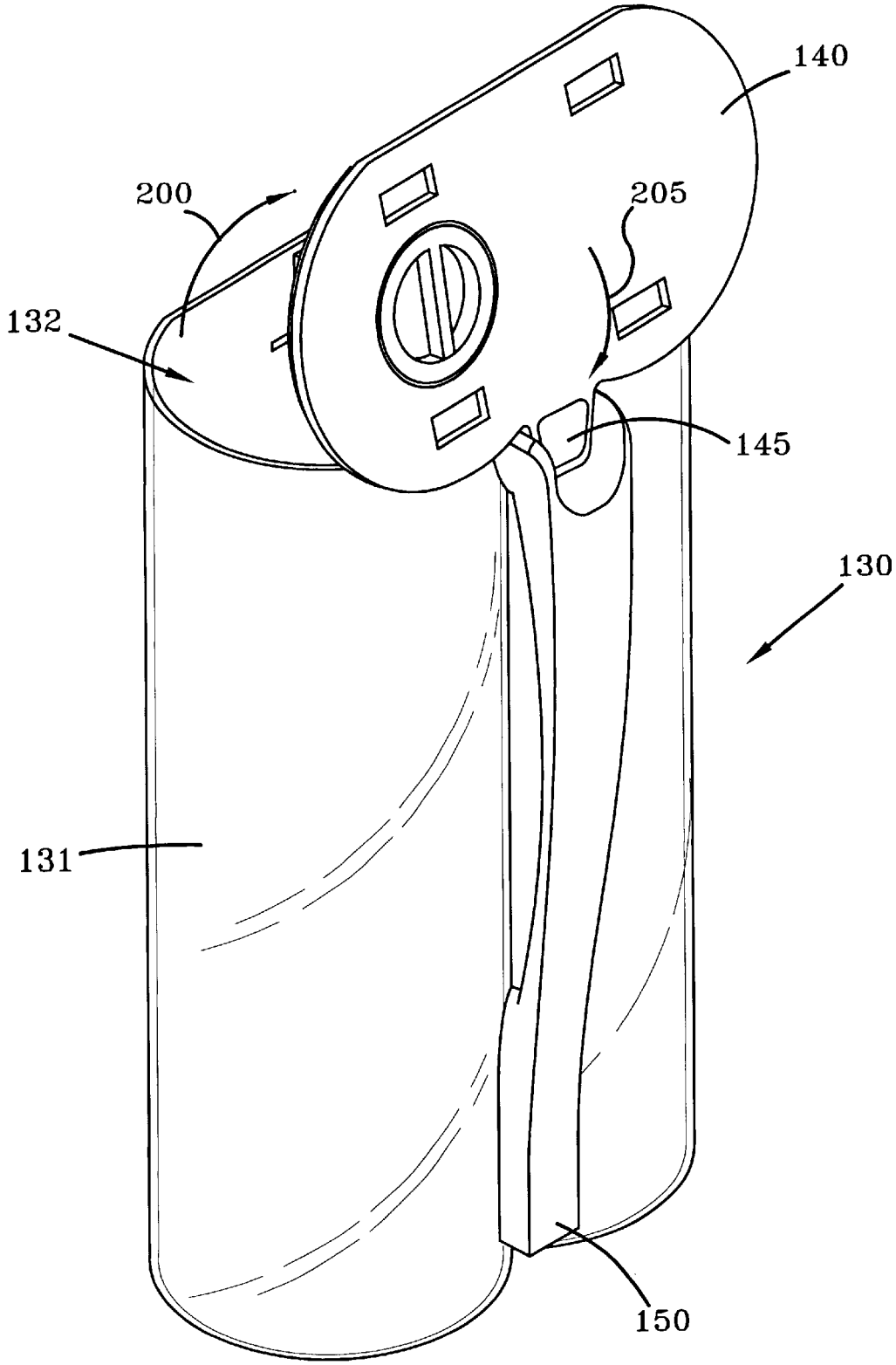
FIG. 5 is a left perspective view of the dirt collecting assembly of FIG. 3 with the lid in the open position.
Figure 6:
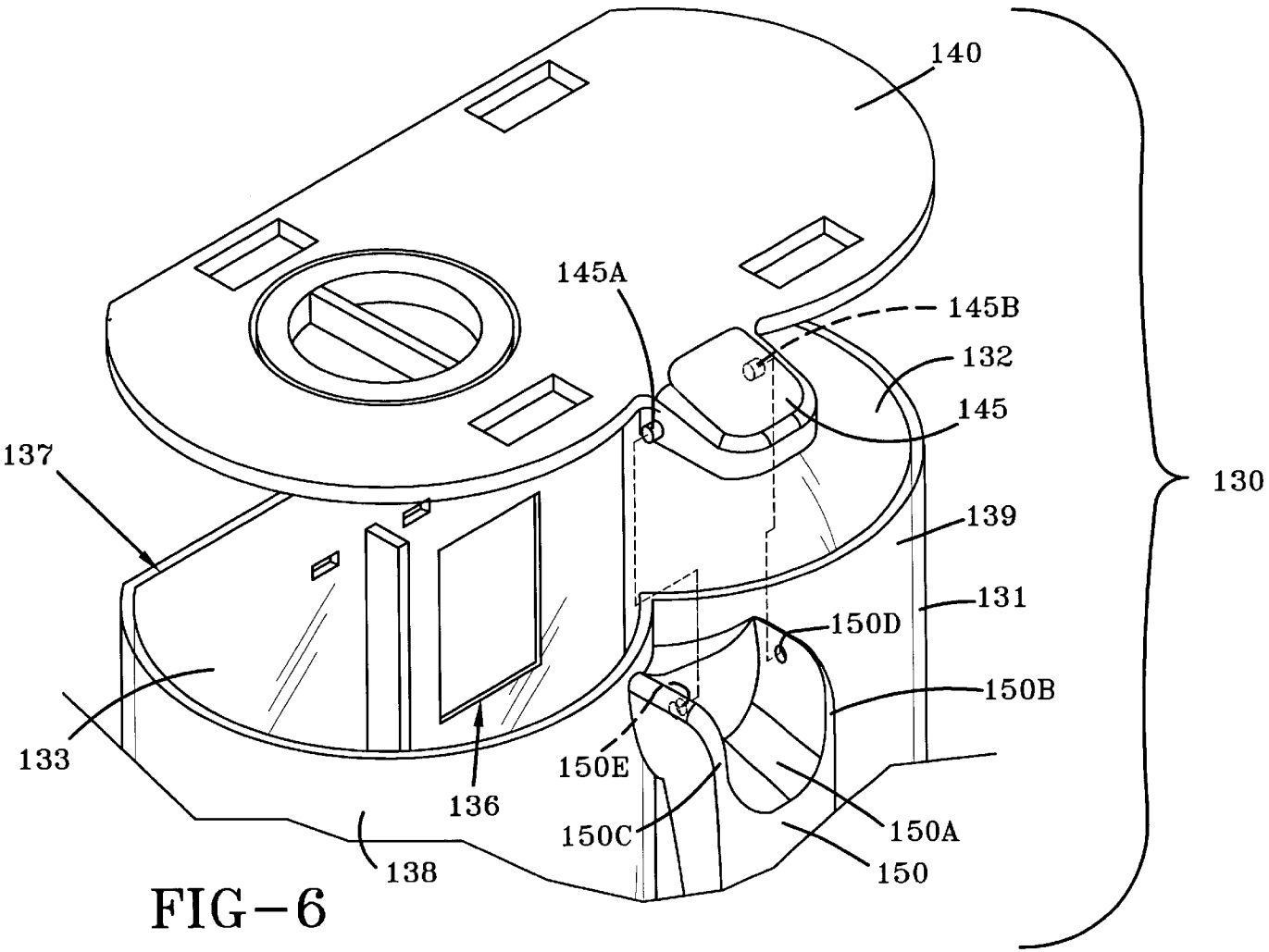
FIG. 6 is an exploded left perspective view of the upper portion of the dirt collecting assembly with the lid removed.

Referring now to FIG. 6, shown is an exploded view of the upper portion of dirt cup 131 and lid 140 with lid 140 removed from dirt cup 131. A pairs of pivot pins 145*a*, 145*b* protrude from opposing sides of thumb tab 145 for engaging a complementary pair of apertures 150*d*, 150*e* on opposing sidewalls 150*b*, 150*c* forming a cavity 150*a* at the top of handle 150. The cavity 150*a* gives the front portion of thumb tab 145 space to rotate into so that lid 140 may be moved from the closed position (FIG. 4) to the open position (FIG. 5).

Accordingly, the improved dirt collecting system for a vacuum cleaner is simplified, provides an effective, inexpensive, and efficient device which achieves all of the enumerated objectives. While there has been shown and described herein a single embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. In an improved dirt collecting system for a vacuum cleaner, the vacuum cleaner having a motor-fan assembly with a suction inlet opening, an agitator chamber, a dirt collecting chamber, and a housing, the motor-fan assembly creating a dirt laden airstream from the agitator chamber to the dirt collecting chamber, the improvement comprising a dirt collecting chamber comprised of a dirt cup for collecting dirt particles, the dirt cup comprised of:

a bottom wall;

a rear wall extending generally upward from said bottom wall;

a pair of curved side walls, wherein said pair of curved sidewalls, said rear wall, and said bottom wall define the dirt collecting chamber;

a dirty air inlet opening formed in one of said pair of curved sidewalls, said rear wall, or said bottom wall;

a clean air outlet opening formed in one of said pair of curved sidewalls, said rear wall, or said bottom wall;

a lid having an open position and a closed position pivotally connected to said dirt cup, said lid including a peripheral edge, and a thumb tab extending radially outward from said lid for pivoting said lid between said open position and said closed position.

2. The improved dirt collecting system for a vacuum cleaner of claim 1, wherein said dirt cup further includes a handle attached to said pair of curved sidewalls.

3. The improved dirt collecting system for a vacuum cleaner of claim 2, wherein said lid is pivotally connected to said dirt cup at a top end of said handle.

4. The improved dirt collecting system for a vacuum cleaner of claim 3, wherein said lid is pivotally connected to said handle with a pair pivot pins received by a complementary pair of apertures located in a pair of opposing sidewalls of a cavity located at the top end of said handle.

5. In an improved dirt collecting system for a vacuum cleaner, the vacuum cleaner having a motor-fan assembly with a suction inlet opening, an agitator chamber, a dirt collecting chamber, and a housing, the motor-fan assembly creating a dirt laden airstream from the agitator chamber to the dirt collecting chamber, the improvement comprising a dirt collecting chamber comprised of a dirt cup for collecting dirt particles, the dirt cup comprised of:

a bottom wall;

a rear wall extending generally upward from said bottom wall;

a pair of curved side walls, wherein said pair of curved sidewalls, said rear wall, and said bottom wall define the dirt collecting chamber;

a dirty air inlet opening formed in one of said pair of curved sidewalls, said rear wall, or said bottom wall;

a clean air outlet opening formed in one of said pair of curved sidewalls, said rear wall, or said bottom wall;

a handle having a cavity at an upper end;

a lid having an open position and a closed position pivotally connected to said dirt cup, said lid including a peripheral edge; and a thumb tab extending radially outward from said lid for pivoting said lid between said open position and said closed position.

6. The dirt cup of claim 5, wherein said dirt cup further includes a handle.

7. The dirt cup of claim 6, wherein said lid is pivotally connected to said dirt cup at a top end of said handle.

8. The dirt cup of claim 7, wherein said lid is pivotally connected to said handle with a pair pivot pins received by a complementary pair of apertures located in a pair of opposing sidewalls of a cavity located at the top end of said handle.

9. A method of removing accumulated dirt particles and debris from a dirt collecting system for a vacuum cleaner, comprised of the steps of:

providing a vacuum cleaner having a dirt collecting system including a dirt cup for collecting dirt particles and debris filtered from a dirt laden airstream generated by the dirt collecting system;

providing a lid pivotally connected to said dirt cup having a closed position and an open position;

providing a handle attached to the dirt cup;

providing a thumb tab extending from a peripheral edge of said lid;

directing the dirt laden airstream into the dirt cup and depositing dirt particles and debris into the dirt cup;

grasping the handle with one hand and removing the dirt cup from the vacuum cleaner;

depressing the thumb tab with a thumb from the same hand to move the lid from the closed position to the open position; and inverting the dirt cup to remove accumulated dirt particles and debris from the dirt cup.

10. The method of removing accumulated dirt particles and debris from a dirt collecting system for a vacuum cleaner of claim 9, further comprised of the steps of:

turning the dirt cup upright;

releasing the thumb tab and allowing the lid to return to the closed position from the open position; and inserting the dirt cup into the vacuum cleaner.

11. An improved dirt collecting system for a vacuum cleaner, the vacuum cleaner having a motor-fan assembly with a suction inlet opening, an agitator chamber, a dirt collecting chamber, and a housing, the motor-fan assembly creating a dirt laden airstream from the agitator chamber to the dirt collecting chamber, the improvement comprising a dirt collecting chamber comprised of a dirt cup for collecting dirt particles, the dirt cup comprised of:

a bottom wall;

a rear wall extending generally upward from said bottom wall;

a pair of curved side walls, wherein said pair of curved sidewalls, said rear wall, and or said bottom wall define the dirt collecting chamber;

a dirty air inlet opening formed in one of said pair of curved sidewalls, said rear wall, or said bottom wall;

a clean air outlet opening formed in one of said pair of curved sidewalls, said rear wall, or said bottom wall;

a handle having a cavity at an upper end;

a lid having an open position and a closed position pivotally connected to said dirt cup, said lid including a peripheral edge; and a thumb tab extending radially outward from said lid for pivoting said lid between said open position and said closed position;

wherein said thumb tab extends into said cavity in said handle and rotates therein as said lid is pivoted between said closed position and said open position.

* * * * *